US005275414A

United States Patent [19]

Stephens et al.

[11] Patent Number: 5,275,414

[45] Date of Patent: Jan. 4, 1994

[54] MODIFIED CHESS GAME FOR TEAM PLAY

[76] Inventors: Ryan K. Stephens; Christopher L. Zeis; Ronald R. Plew; Robert E. Mattsey, all of P.O. Box 47, Maxwell, Ind. 46154

[21] Appl. No.: 35,305

[22] Filed: Mar. 22, 1993

[51] Int. Cl.[5] ..... A63F 3/02

[52] U.S. Cl. ..... 273/261

[58] Field of Search ..... 273/260, 261

[56] References Cited

U.S. PATENT DOCUMENTS

| | | | |
|---|---|---|---|
| 511,773 | 1/1894 | Higgins | 273/261 |
| 3,843,130 | 10/1974 | Whitney, Jr. | 273/261 |
| 4,696,478 | 9/1987 | Farrell | 273/261 |
| 4,708,349 | 11/1987 | Shomer | 273/261 |

OTHER PUBLICATIONS

Chess Variations by John Gollon, Charles F. Tuttle Company, pp. 203–208, 1968.

*Primary Examiner*—Benjamin H. Layno

[57] ABSTRACT

A method for playing team chess has been devised by using a modified chess board and using conventional chess rules. The gameboard has a square matrix of fourteen squares by fourteen squares. Four sets of conventional chess pieces are used, each set containing one king, one queen, two bishops, two knights, two rooks, and eight pawns. Each set of chess pieces differ in color, with two sets of pieces having light colors representing one team and two sets of chess pieces having dark colors representing the other team. The chess pieces move according to the conventional rules of chess. Each player's king must be checkmated two times by the opposing players before the player is removed from the game. A player in checkmate remains in checkmate and is unable to move any of his/her playing pieces during the player's subsequent turns until either his partner blocks the checkmating piece, or his partner captures the checkmating piece, or one of the opposing players moves one of the opposing playing pieces into a position so that the checkmate is removed. Playing pieces of the removed player remain on the board cannot be moved for the remainder of the game and can only be removed when captured.

1 Claim, 2 Drawing Sheets

K=KING
Q=QUEEN
B=BISHOP
N=KNIGHT
R=ROOK
P=PAWN

K=KING
Q=QUEEN
B=BISHOP
N=KNIGHT
R=ROOK
P=PAWN

MODIFIED CHESS GAME FOR TEAM PLAY

SUMMARY

A chess game is provided with minimal differentiations to allow exclusive team play. The game apparatus includes a modified chess board, having fourteen squares by fourteen squares, and four sets of chess pieces, each set differed by color. The modified game board is simply a checker board enlarged by the amount of squares, with two alternating colors. The purpose of the invention is for the introduction of new chess strategies with the mental coordination of partners challenging partners. Some of the basic strategies of conventional chess are roots for the progression of strategies in this game.

BACKGROUND OF THE INVENTION

1. Field of the invention

This invention relates to the conventional game of chess and is exclusively a game variated from the original version in order for participants to play team chess, two partners against two partners. Since chess has been around for centuries, it is probably the most popular and strategically developed board game, but it is limited to two players. Although chess is such a great game within itself, a modified game for team chess will circulate more interest in conventional chess as well as contribute to family enjoyment. This invention will also give avid chess players the opportunity to pursue a much more defined challenge outside conventional chess.

2. Description of Prior Art

Chess has been around for ages and although there have been attempts to alter the game for more than two persons, none have really been accepted by the public, evidence being that none of these games have actually hit big on the market. The alterations of these said revised games vary from drastic changes and complications in the rules of conventional chess to radical alteration of the playing board. Games have been submitted for three and four person play, but no one game is exclusively partner play, that is, team chess. This invention is relatively simple and easy for just about anyone to understand. Conventional chess is sophisticated enough without making numerous changes which may easily confuse a beginner. There is a need for another game that is mentally challenging, a game that meets all logical specifications for partner chess, yet will remain simple for anyone to enjoy.

THE PREFERRED EMBODIMENTS

Figure 1:
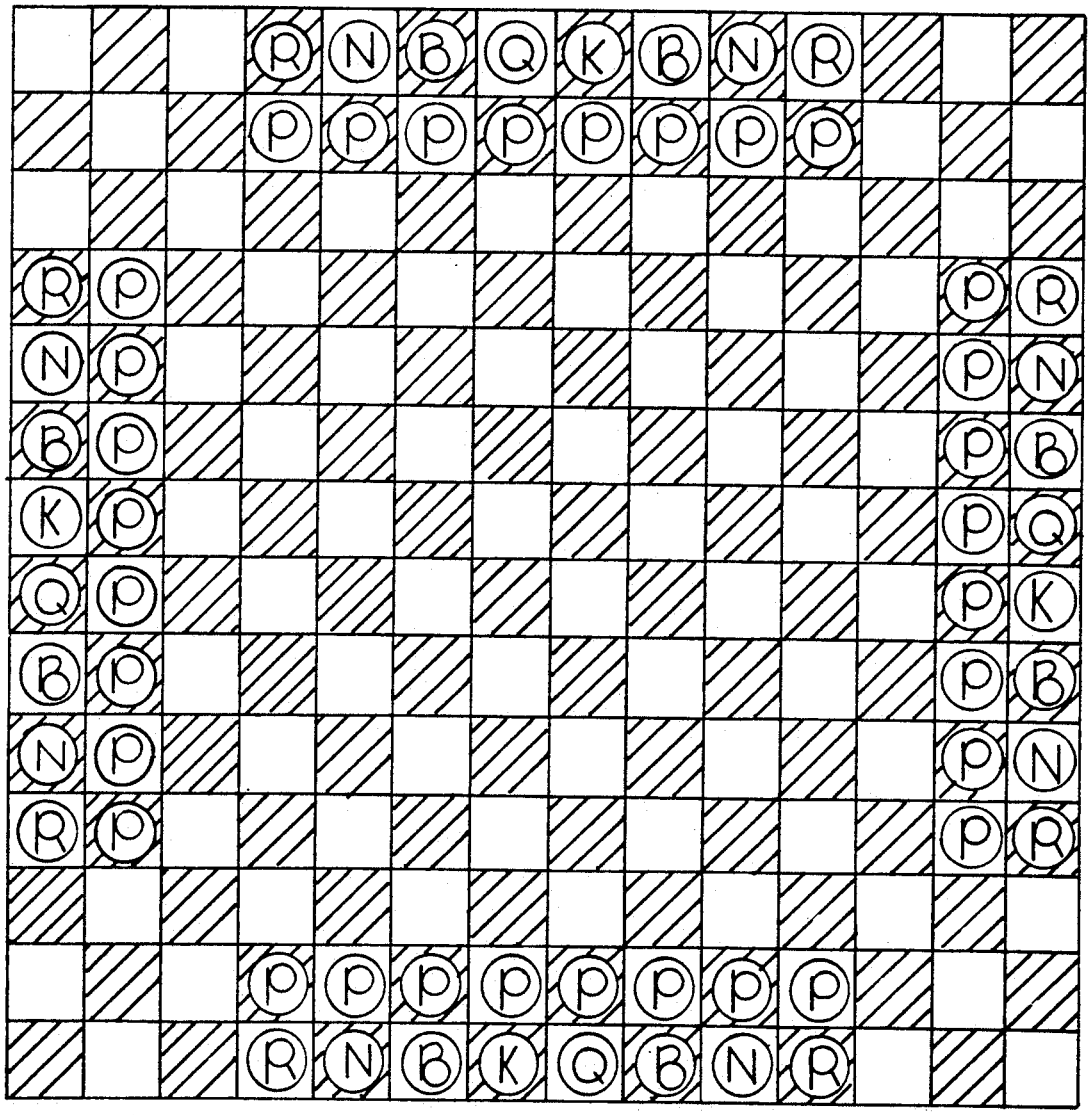
FIG. 1 is a view of the playing board with all four sets of chess pieces in their initial positions.
Figure 2:
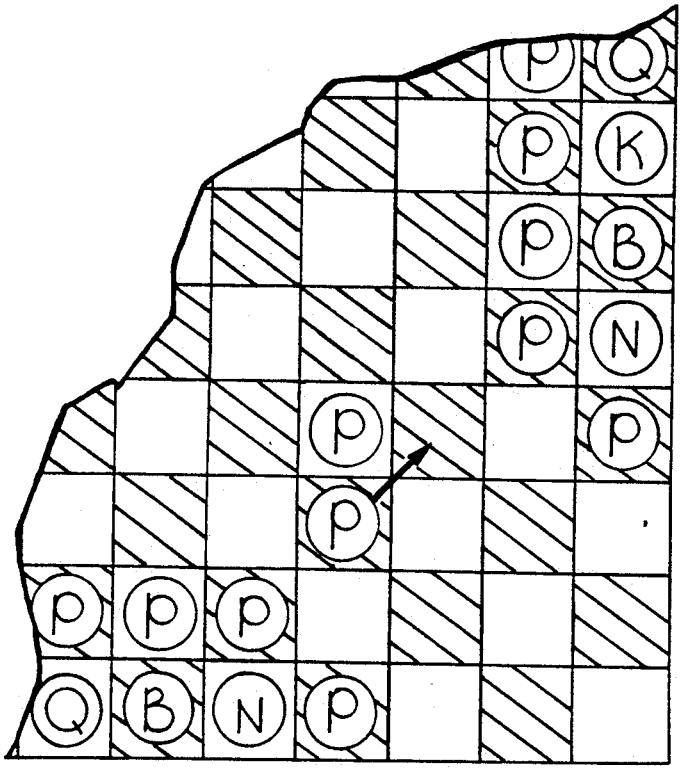
FIG. 2 is a view of the playing board, exemplifying the en passant move of the pawn. The concept is the same as in conventional chess, with the pawn attacking the opponent's pawn to the right and moving behind, as shown.

The following descriptions of the invention are only the preferred embodiments and are not limited to those details mentioned below in this section. They are only suggestions for the apparatus to be used.

The gameboard to be used is a modified checkerboard having fourteen squares by fourteen squares, having a total of 196 alternating black and white squares. The suggested size for each square on the gameboard is approximately two inches by two inches square to allow for the base of the chess pieces to fit on each square comfortably. The entire gameboard is used for the playing area. No other changes to the board are necessary for a complete game board.

The playing pieces to be used are conventional chess pieces. There are four sets of chess pieces, each set being of different color. The preferred colors to be used are black, brown, white, and tan, the dark colors being black and brown and the light colors being white and tan. Each set of chess pieces contain one king, one queen, two bishops, two knights, two rooks, and eight pawns, such that is recognizable by any chess player.

RULES OF PLAY

The rules of play for the preferred embodiment of the invention are the very same rules which are used in conventional chess with the following simple modifications:

I. The object is for two partners to prevail against the other partners.

II. As in conventional chess, one may not move the king into a position of jeopardy, that is, where the king will be in check. Since this invention is a team game, a partner cannot move any piece that puts the other partner in check by an opponents piece.

III. As a player can cover his own piece in conventional chess, so can a player cover his partner's piece with one of his own pieces.

IV. The game is won by both opponents being placed in checkmate.

A) Each player is allowed have their king checkmated two times.

B) A player in checkmate remains in checkmate and is unable to move any of his/her playing pieces during the player's subsequent turns until the player is retrieved from checkmate:
if his partner blocks the checkmating piece, or
if his partner captures the checkmating piece, or
if one of the opposing players moves one of the opposing playing pieces into a position so that the checkmate is removed.

C) Once a player has been placed in checkmate twice, that player is out of the game. If this happens and the player's partner is checkmated, the game is over.

V. If a player is checkmated twice, that player is out of the game. However, the player's pieces will remain on the game board and are removed only if captured by another player. A player may at any time capture one of his partner's pieces for the benefit of that team.

VI. If a player is checkmated, the force of his pieces may still be used by the partner to cover the partners pieces. The pieces are still alive, they just cannot be moved.

VII. Stalemate is described as a situation where there are no longer enough playing pieces left on the playing board to accomplish checkmate to either of the sets of partners. As in conventional chess, a three time perpetual check constitutes stalemate. If one partner obtains a stalemate, the outcome of the game is defined as stalemate, that is, a draw. All other rules of stalemate apply as in conventional chess.

VIII. No discussion of strategy during game play, as purpose remains to develop mental coordination.

What is claimed is:

1. A method of playing a four player chess game which consists of four distinguishable sets of playing pieces, one for each player, each set having eight pawns, two rooks, two knights, two bishops, a queen and a king, a square game board consisting of a square matrix of fourteen by fourteen alternatingly colored square playing spaces, the method comprising the steps of:

placing each player's set of playing pieces on the game board so that one set of playing pieces occupies a first row of spaces adjacent and parallel to one side of the game board and occupies a second row of spaces adjacent and parallel to the first row of spaces, and the other three sets of playing pieces similarly occupies the first and second row of spaces adjacent and parallel to the other three sides of the game board;

dividing the players into two opposing teams, each team having two partners;

each player moving, in turn, one of their playing pieces anywhere on the game board according to the predetermined movement capabilities as set forth in the standard rules of chess;

allowing each player to have their king checkmated up to two times by players of the opposing team wherein if a player's king is checkmated for the first time the player's king remaining in check and the player being unable to move any of his/her playing pieces during the player's subsequent turns until the player's partner retrieves the player's king from checkmate by moving one of the partner's playing pieces in position to block or capture the opposing player's checkmating piece, or one of the opposing players moving one of the opposing playing pieces into a position so that the checkmate is removed;

removing a player from the game once the player's king is checkmated for the second time;

keeping the remaining playing pieces of the removed player in the same location on the board at the time the player was removed from the game and keeping these remaining playing pieces at these locations until the end of the game or until these remaining playing pieces are captured by playing pieces of players still in the game;

the players still in the game, using the removed player's remaining playing pieces as obstacles which the player's must either capture or move around, and using the removed player's remaining playing pieces as barriers to hide behind for protection against playing pieces of the opposing team;

a team winning the game once one of the opposing team's players is removed from the game and the opposing team's remaining player is checkmated.

* * * * *